US007350593B1

(12) United States Patent
Brookover

(10) Patent No.: US 7,350,593 B1
(45) Date of Patent: Apr. 1, 2008

(54) ELECTRONICALLY CONTROLLED EARTH DRILLING RIG

(75) Inventor: Brian David Brookover, West Chester, PA (US)

(73) Assignee: Schramm, Inc., West Chester, PA (US)

( * ) Notice: Subject to any disclaimer, the term of this patent is extended or adjusted under 35 U.S.C. 154(b) by 0 days.

(21) Appl. No.: 11/593,860

(22) Filed: Nov. 7, 2006

(51) Int. Cl.
*E21B 19/084* (2006.01)
*E21B 44/02* (2006.01)
*B23Q 15/12* (2006.01)

(52) U.S. Cl. ..... 175/27; 175/24; 175/40; 175/203; 173/4; 173/11

(58) Field of Classification Search ..... 175/24, 175/27, 40, 203; 173/4, 11, 19, 206
See application file for complete search history.

(56) References Cited

U.S. PATENT DOCUMENTS 2,913,225 A * 11/1959 Wolfram ..... 175/135
5,219,247 A * 6/1993 Gemmi et al. ..... 405/241
7,138,925 B2 * 11/2006 Nield ..... 340/685
2005/0216116 A1 * 9/2005 Nield ..... 700/213
2007/0089878 A1 * 4/2007 Newman ..... 166/255.1

* cited by examiner

*Primary Examiner*—Jennifer H Gay
*Assistant Examiner*—Shane Bomar
(74) *Attorney, Agent, or Firm*—Howson & Howson LLP

(57) ABSTRACT

An electronic control, for automated earth drilling using a pneumatic hammer-operated bit, preliminarily weighs a drill string, and, during drilling, automatically maintains a desired weight on the bit, and also maintains a constant rate of drilling progress by regulating drill string rotation speed. The weight on the bit is automatically maintained at a fraction of the pre-established desired weight as the air pressure in the supply to the pneumatic hammer builds up to an operating level. The control detects voids and broken formations by monitoring air pressure and torque respectively, and responds by reducing the weight on the bit. The control automatically raises the drill bit though a short distance as the drill head reaches the lower limit of its travel, pauses until the air pressure drops, and then raises the drill string to a position for insertion of a new length of pipe.

17 Claims, 4 Drawing Sheets

ELECTRONICALLY CONTROLLED EARTH DRILLING RIG

FIELD OF THE INVENTION

This invention relates to earth drilling, and more particularly to a control system for improving drill performance.

BACKGROUND OF THE INVENTION

Earth drilling rigs, of the kind used to drill water wells, and for mineral exploration, etc., typically comprise a vehicle-mounted tilting mast, a drill head (sometimes referred to as a "gearbox" since a gear transmission is its principal component) movable up and down the mast by a hydraulic hoist, and a hydraulic motor carried by the drill head for rotating a drill string. A pneumatic hammer is typically provided at the bottom of the drill string for repeatedly striking an anvil at the top of a drill bit. The bit typically has an array of carbide buttons for cutting rock. Hydraulic fluid and compressed air are provided by pumps and a compressor mounted on the vehicle and operated by an engine also mounted on the vehicle.

Drilling requires skill and experience for several reasons. Efficient drilling requires selection of an appropriate drilling speed, and maintenance of an appropriate downfeed or hold-back force on the drill string. The magnitude of the force must be adjusted each time a drill pipe is added to the drill string, and the direction of the force must be changed from downward to upward when the number of pipe sections making up the drill string is sufficient that the weight of the drill string itself can supply the necessary downward force.

Operator skill and experience are especially important because unexpected conditions, frequently encountered in drilling operations, require rapid operator response. Such conditions include, for example, underground formations that can cause a drill bit to become stuck, underground voids, and the like.

When a pneumatic hammer is used at the bottom of the drill string, skill and experience are also required to avoid "crowding" of the drill bit. That is, if the drill string is advanced against the bottom of a bore hole before the air pressure delivered to the hammer is sufficiently high, the hammer can fail to operate, and the downward force exerted on the bit can cause breakage of the carbide buttons.

BRIEF SUMMARY OF THE INVENTION

The preferred earth drilling rig in accordance with the invention comprises a hydraulically operated drill head for rotating a hollow drill string, an elongated mast for supporting the drill head, a hollow drill string comprising at least one pipe section connected to, and rotatable by, the drill head, a hydraulically operated hoist for moving the drill head longitudinally along the mast, a hydraulic pump mechanism for supplying hydraulic fluid under pressure for driving the drill head and hoist, and a pneumatic hammer connected to the drill string, a drill bit connected to the pneumatic hammer.

The drill bit is rotatable with the drill string, and subjected to repeated impact by the pneumatic hammer. The drill rig also includes an air compressor, connected to the drill head, for causing compressed air to flow through the drill string for operation of the pneumatic hammer. Valving and regulators are provided for controlling and regulating the flow of hydraulic fluid to the drill head and the hoist. The drill rig also includes a drill head position sensor, a sensor for sensing the pressure of the hydraulic fluid operating the hoist and a sensor for sensing the pressure of the hydraulic fluid driving the drill head. A programmed electronic control controls the flow of hydraulic fluid through the valving to the hoist and drill head. The electronic control is responsive to the sensors, and connected to control operation of the hoist and drill head. The electronic control is programmed to do one or more of the following.

First, it may be programmed to operate the hoist and drill head, while the bit is in a bore hole, to rotate the drill string, and raise the drill string to a fixed position by an amount sufficient to ensure that the bit is free to move vertically in the bore hole. The control then measures the hydraulic pressure required to hold the drill string in the fixed position, thereby obtaining a pressure measurement corresponding to the actual weight of the drill string. After obtaining the weight of the drill string, the control lowers the drill string to engage the bit with the bottom of the bore hole. The controls regulate the pressure of the hydraulic fluid operating the hoist while monitoring the pressure of compressed air delivered to the pneumatic hammer, and thereby maintains the effective weight on the bit at a fraction of a predetermined operating level until the air delivered to the pneumatic hammer reaches a predetermined air operating level. After the predetermined air operating level is reached, the control regulates the pressure of the hydraulic fluid operating the hoist during drilling, and thereby maintains the effective weight of the drill string at the predetermined operating level.

The control also monitors the rate of penetration of the drill string, and regulates the speed of rotation of the drill string in response to the rate of penetration, while maintaining the effective weight of the drill string at a predetermined operating level, thereby maintaining a substantially constant rate of penetration.

The control can also be programmed to reduce the effective weight on the bit to a fraction of its predetermined operating level when the pressure of the compressed air delivered to the pneumatic hammer falls below a predetermined level during drilling, for example when a underground void is encountered by the drill bit. The control can also be programmed to monitor the torque in the drill string by monitoring the pressure of the hydraulic fluid driving the drill head, and can reduce the effective weight on the bit when the torque exceeds a predetermined torque level, for example, when the drill bit encounters a broken formation.

In addition, the controller can be programmed to cause the drill head to retract the drill string by a predetermined distance sufficient to raise the drill bit off the bottom of the bore hole and pause, when the drill head position sensor indicates that the drill head has approached the lower limit of its travel on the mast, and cause the drill head to continue to retract the drill string to a position at which an additional drill pipe section can be added to the drill string.

DETAILED DESCRIPTION OF THE PREFERRED EMBODIMENT

Figure 1:
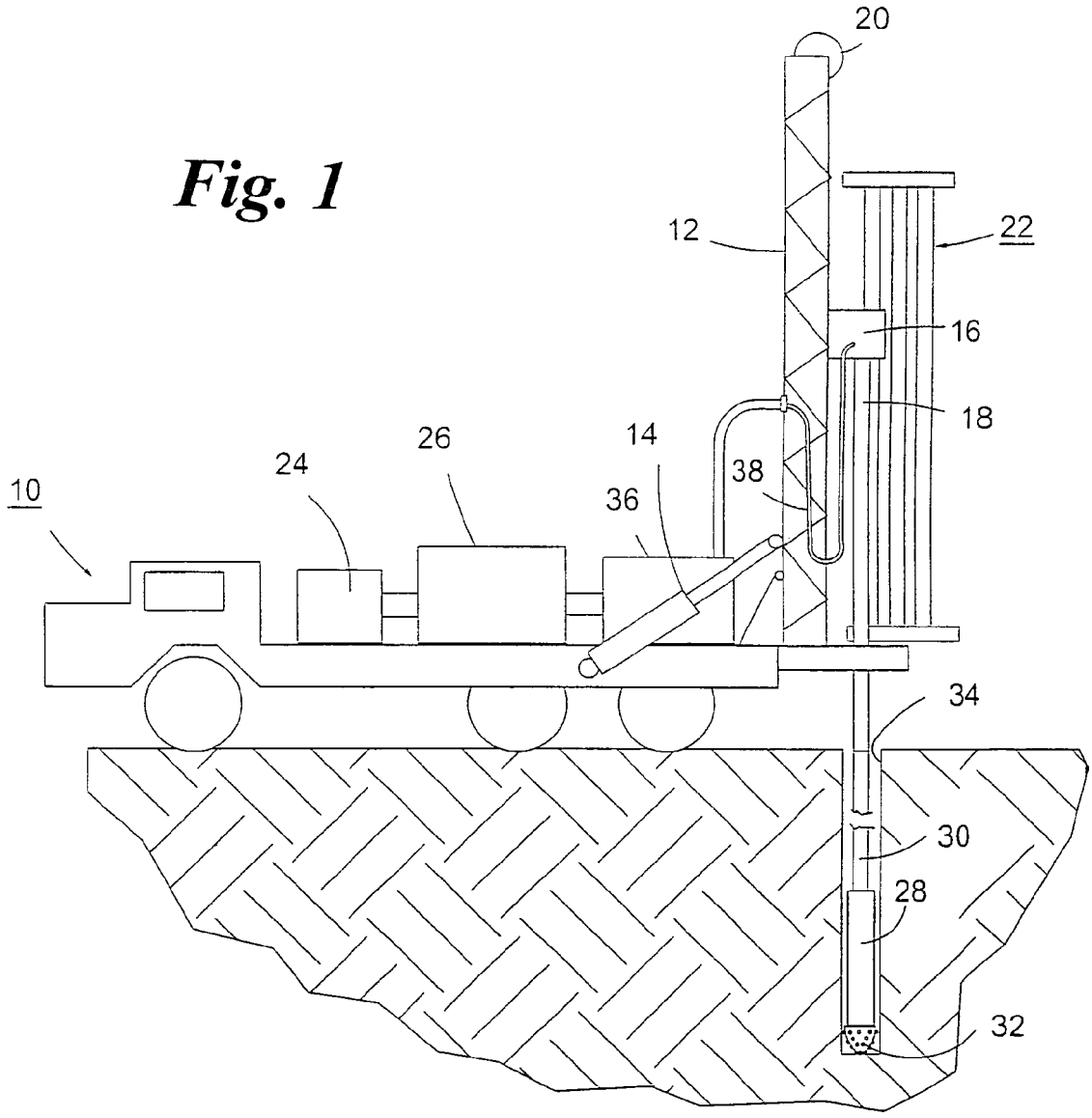
FIG. 1 is a schematic diagram of an earth drilling rig in accordance with the invention.

As shown in FIG. 1, a typical drilling rig is self-propelled, being incorporated onto a vehicle 10. The drilling rig includes an elongated mast 12, which is hinged to the vehicle, and tiltable by one or more hydraulic actuators 14 from a horizontal condition for transport, to a vertical condition, as shown, for drilling. The mast can also be held in an oblique condition for angle drilling.

A drill head 16, for rotating a drill string 18, is guided for longitudinal movement along the mast, and a hydraulically operated hoist 20 is provided for controlling movement of the drill head. The drill string is made up by connecting lengths of pipe supplied from a carousel 22 by means of a transfer mechanism (not shown).

A breakout mechanism (not shown) is provided for connecting and disconnecting lengths of drill pipe to and from one another and for connecting and disconnecting lengths of drill pipe to and from the drill head.

Hydraulic actuators for tilting the mast, operating the hoist, the transfer mechanism, and various other components of the drilling rig, and a hydraulic motor in the drill head for rotating the drill string through a gear transmission, are operated by hydraulic fluid supplied by a set 24 of hydraulic pumps, operated by a Diesel engine 26.

A pneumatic hammer 28 is provided at the lower end of a lowermost section 30 of drill string 18, and a cutting bit 32 is connected to the lower end of the hammer 28. An anvil (not shown), provided as part of the bit, is arranged to be subjected to repeated impact by the pneumatic hammer. The cutting bit can be any one of various types of earth- or rock-drilling bits, and will typically include a set of carbide inserts.

Compressed air is supplied through the drill string to eject cuttings from the borehole 34, and to operate the pneumatic hammer. The air is supplied to the upper end of the drill string, from a compressor 36, through a flexible conduit 38. The compressor 36 is driven by engine 26, which also drives the hydraulic pumps 24. Driving both the hydraulic pumps and the compressor from a single engine, eliminates the need for a separate engine, reduces the overall weight of the drilling rig, and achieves efficient operation.

Figure 2:
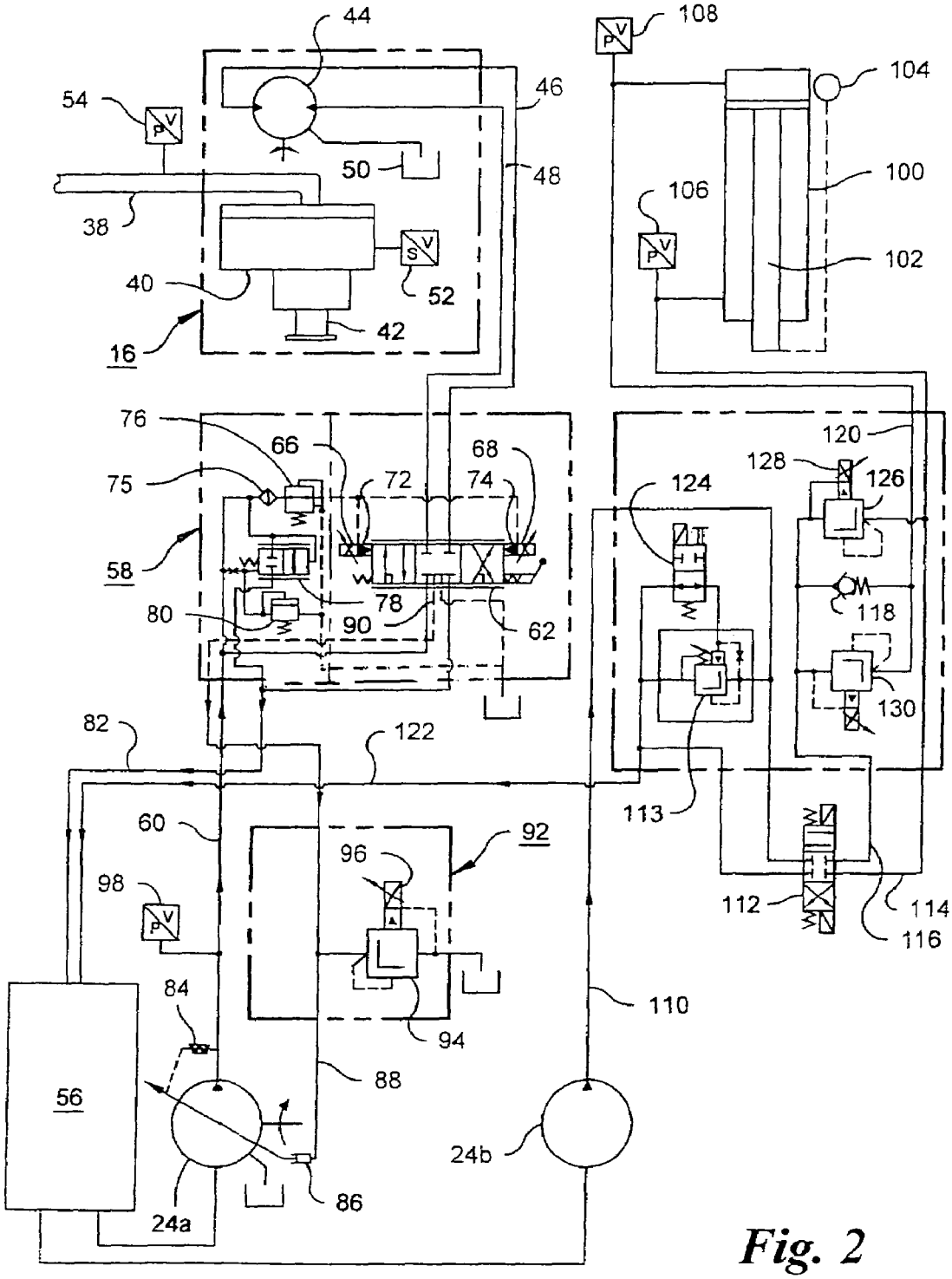
FIG. 2 is a schematic diagram of the hydraulic control system of the drilling rig.

As shown schematically in FIG. 2, the drill head 16 comprises a gearbox 40 having an output shaft 42, which is connectible to the uppermost drill pipe of a drill string. The gearbox is driven by a reversible hydraulic motor 44, which is connected to fluid lines 46 and 48 and to a drain 50.

The gearbox 40 is provided with an inductive rotation speed sensor 52, which produces a series of electrical pulses which can be counted. The pulse count in a given interval of time corresponds to the rotation speed of the drill string.

Compressed air conduit 38 is connected to the gear box in order to deliver air to the drill string. The air conduit is provided with an air pressure sensor 54, which is a pressure to voltage ("P/V") transducer.

Hydraulic fluid for operating the reversible hydraulic motor 44 is delivered from a hydraulic fluid supply tank 56 through hydraulic pump 24*a* and a hydraulic valve assembly 58. Hydraulic fluid flows from pump 24*a*, through line 60, to an infinite positioning, four-way valve 62, which can deliver hydraulic fluid either to line 46 with a return path through lines 48 and 82, or to line 48 with a return path through lines 46 and 82.

Figure 3:
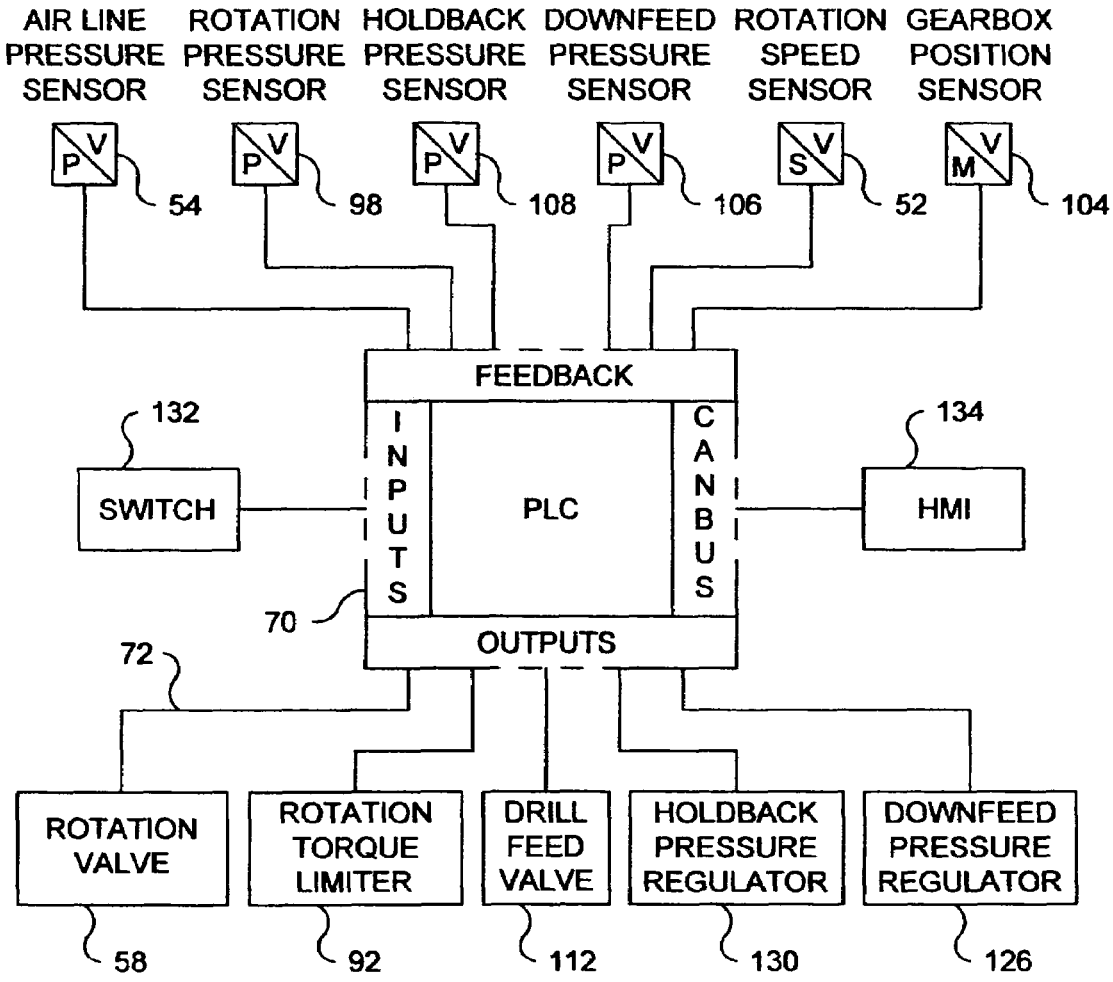
FIG. 3 is a schematic diagram showing the relationship between the sensors, valves and regulators of the hydraulic control system and a programmed logic controller in a preferred embodiment of the invention.

The spool of the four-way valve 62 is moved by two electrically operated linear actuators 66 and 68, which receive their command signals from a programmed logic controller (PLC) 70, shown schematically in FIG. 3, through an electrical signal path 72 (FIG. 3). The actuators are continuously adjustable, and the positions of their output shafts are proportional to current supplied by the programmed logic controller 70. The actuators control the amount of pressure applied to the second stages 72 and 74 of a pair of two stage pilot valves. Pressure from line 60 is applied to the second stages of the pilot valves through a strainer 75 and a regulator 76. Valve 78 is a two position main relief cartridge. System pressure in line 60, together with a spring associated with valve 78, normally hold the cartridge in the closed position as shown, blocking flow from line 80 back to supply tank 76 through return line 82. Valve 80 is a pilot valve which relieves the pressure applied to the spring side of the cartridge when the system pressure in line 60 reaches a predetermined level corresponding to the set point of the pilot valve. When the pressure applied to the spring side of the cartridge is relieved, the system pressure on the opposite side of the spool of valve 78 shifts the cartridge to its open position, thereby connecting line 60 to return line 82.

Pump 24*a* is a variable displacement pump, and is biased toward its maximum displacement setting by a piston 84. A control piston 86 is a load sensing control responsive to fluid pressure in line 88. Line 88 is connected to a load sensing port 90 in valve 62, which samples the pressure of the fluid delivered to hydraulic motor 44, when the valve is opened, either for forward or reverse rotation of the motor.

A rotation torque limit control 92 comprises a non-reversing valve 94, operated by a reverse-acting, electrically controlled, actuator 96, which sets the hydraulic pressure applied to the spool of valve 94.

Line 60, which leads from pump 24*a* to valve 62, is provided with a rotation pressure sensor 98.

Pump 24*b* is the hydraulic pump that provides fluid pressure for operating the hoist that moves the drill head along the mast. The hoist comprises a traverse cylinder 100, the piston 102 of which drives the drill head, in the conventional manner, through a set of chains and sprockets (not shown), including traveling sprockets arranged so that the travel of the drill head is twice that of the piston 102. The sprockets and chains cause the drill head to move upward as the piston 102 moves downward. The traverse cylinder is provided with a drill head gearbox position sensor 104, and with down feed and holdback pressure sensors 106 and 108 respectively.

Hydraulic fluid is delivered by pump 24*b*, through line 110, to a directional drill feed valve 112. The drill feed valve is a solenoid-actuated, three-position valve which can deliver hydraulic fluid either through line 114 to the downfeed side of the piston, or through line 116, check valve 118, and line 120 to the upfeed (or holdback) side of the piston. A return line 122 leads from the valve 112 to the hydraulic fluid supply tank 56.

Hydraulic fluid line 110 is connected to a non-reversing main relief valve 113, which drains fluid to the supply tank 56 through return line 122. The main relief valve is enabled by a pilot valve 124, which is controllable by a solenoid, but which is also provided with a manual override pin. During idling conditions, the main relief valve is set to relieve pressure in line 110 at a relatively low level, for example, 150 psi. When the valve 112 is enabled, however, it is set to relieve pressure in line 110 at a relatively high level, for example, 4200 psi.

A downfeed pressure regulator 126 is connected between line 116 and line 114 to control the pressure of the fluid delivered to the downfeed side of the traverse cylinder 100.

This regulator is a non-reversing, infinitely positioning, valve, controlled by a hydraulic pilot, which is in turn controlled by a linear actuator 128. A similar valve 130, is connected between line 120 and line 116.

When the drill stem is being raised, valve 112 delivers hydraulic fluid to the holdback side of cylinder 100, through check valve 118 and line 120, without regulation. During drilling, fluid pressure is applied through line 114 to the downfeed side of cylinder 100, and is regulated by regulator 126. At the same time, a holdback force is maintained by restriction of the flow of fluid from the holdback side of the cylinder, using regulator 130.

As shown in FIG. 3, the programmed logic controller is provided with a switch 132, for engagement of the control function, and a human-machine interface (HMI) 134 connected to the controller through a Controller Area Network Bus (CANBUS). The human-machine interface can take various forms, but preferably comprises a video display on which pressure data from the various sensors can be displayed along with indications of operating conditions such as drilling rate, derived from the gearbox position sensor 104, and rotation speed, obtained directly from sensor 52. The human-machine interface may also include means for permitting an operator to enter settings manually. Such means can include, for example, manually operable switches, manually variable resistances, or any of a variety of graphical user interface (GUI) input devices such as touch-screen inputs, joysticks, etc.

Figure 4:
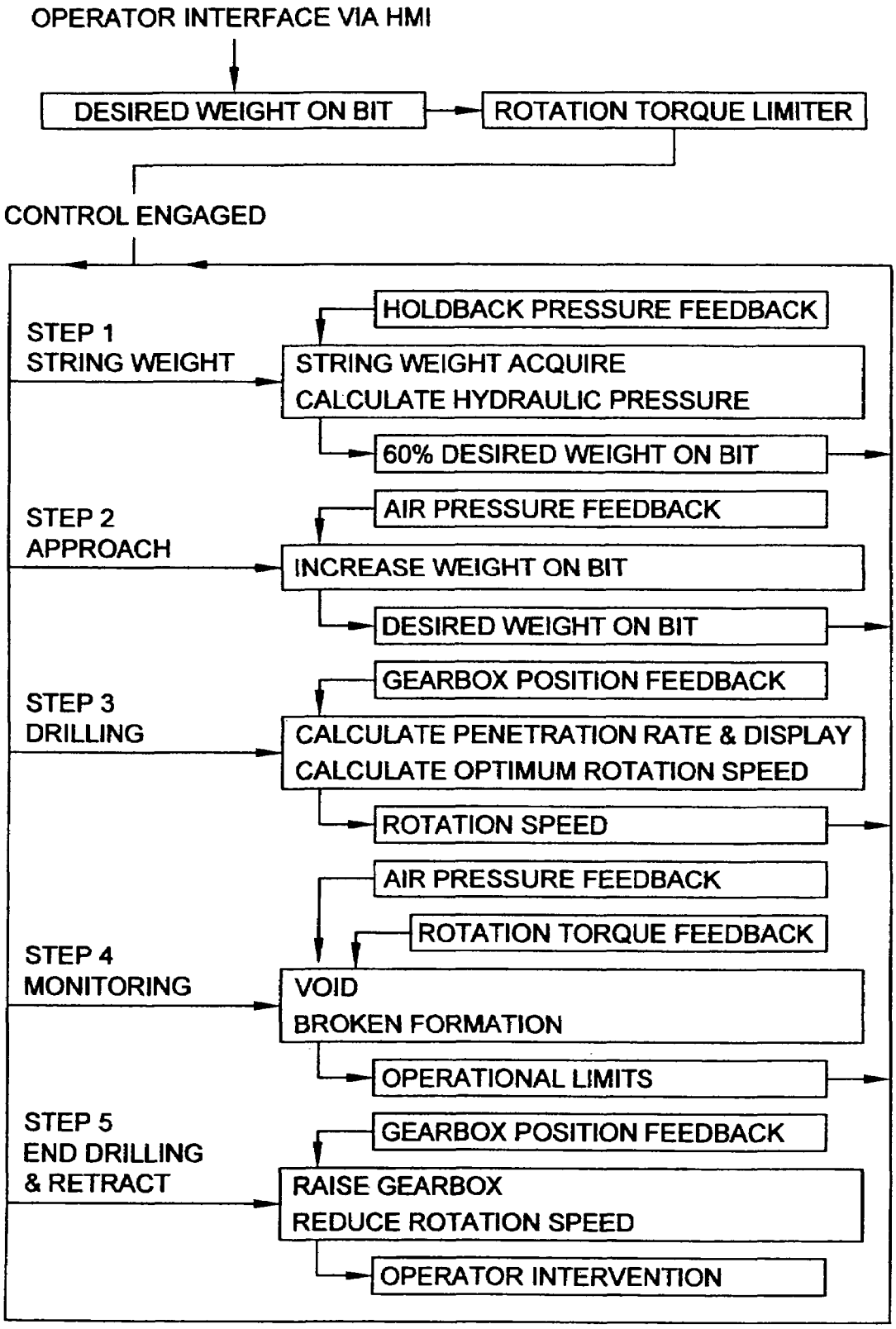
FIG. 4 is a flow diagram illustrating the operation of the control system.

In the operation of the system, as depicted in FIG. 4, an operator enters a desired weight on the drill bit, and a desired rotational torque limit using the human-machine interface. The PLC 70 then sets the rotation torque limiter 92 (FIGS. 2 and 3) accordingly. When the machine operator engages switch 132, the control system proceeds with a sequence of steps.

The first step is the determination of the drill string weight. This step may be initiated at the beginning of drilling when the drill string consists of the bit, the air hammer, and only one length of drill pipe, and may also be initiated at any time after an interruption in the drilling process. The drill string weight will, of course, depend primarily on the number of lengths of drill pipe in the drill string, but may also be affected by the choice of drill bit and the choice of air hammer. Drill string weight will also depend on the drilling angle. If drilling is carried out while the mast is tilted, the effective weight of the drill string can be increased by an amount depending on the drilling angle, and the coefficient of friction of the material being drilled.

The control, by operating the rotation valve 58, causes the drill string to rotate clockwise, and, at the same time, operates the drill feed valve so that the traverse cylinder raises the drill string to a fixed position, preferably only a small fraction of a meter above the bottom of the bore hole, to ensure that the bit is free to move vertically. The control then operates drill feed valve 112 so that it vents the downfeed side of the traverse cylinder to atmospheric pressure. Then, by adjusting the holdback regulator 130 while simultaneously monitoring the drill head position, as sensed by sensor 104, and holdback pressure as sensed by sensor 108, the controller records the hydraulic pressure required to support the drill string in a fixed position above the bottom of the bore hole. The recorded hydraulic pressure corresponds to the actual weight of the drill string (including the drill head). The weight of the drill string can be displayed on the HMI 134. From the recorded drill string weight and the previously entered desired weight on the drill bit, the logic in the controller calculates the hydraulic pressure required to achieve the desired weight on the bit.

When a drill string comprises about five or six twenty-foot lengths of drill pipe, the weight of the drill string itself is usually enough to supply the desired weight on the drill bit without the assistance of downfeed pressure applied to the hoist cylinder 100. When more lengths of pipe are added, the desired weight is maintained by applying fluid pressure to the holdback side of the hoist cylinder.

The programmed logic in the controller 70 also calculates a predetermined fraction, e.g., 60%, of the desired weight on the bit for the purpose of establishing an approach weight that is less than the full operating weight. Depending on the calculated weight of the drill string, the controller 70 operates either the downfeed regulator 126, or the holdback regulator 130 so that the bit is advanced to the bottom of the bore hole. However, when the bit reaches the bottom of the bore hole, the hydraulic fluid pressure applied to the hoist cylinder initially establishes an effective weight on the bit corresponding to the predetermined fraction, typically 60%, of the previously selected desired weight.

The next step (step 2 in FIG. 4) is to increase the weight on the bit gradually while increasing the air pressure applied to the drill string through air conduit 38. The air pressure is monitored using sensor 54, and used to control the increase of weight on the bit. As the air pressure builds up toward an operating level, typically 220 psi or more, the full predetermined weight on the bit is applied. The gradual increase in weight on the bit avoids crowding of the drill bit as the air pressure applied to the hammer builds up.

After the predetermined air operating level is reached, the control regulates the pressure of the hydraulic fluid operating the hoist during drilling, and thereby maintains the effective weight of the drill string at the predetermined operating level.

During normal drilling, the preferred penetration rate is usually a rate such that, with each revolution of the bit, the bit moves forward by a distance approximating the length of the cutting teeth of the bit, e.g., about 1 cm. During drilling (step 3 in FIG. 4), the control 70 also calculates the rate of penetration of the drill string by calculating the time derivative of the signal provided by position sensor 104 (gear box position feedback). The penetration rate may be displayed on the HMI screen. The control then calculates the optimum drill rotation speed, which, in rpm, is usually about one-half the penetration rate in feet per hour. The control adjusts the rate of rotation of the drill string by opening valve 62 to the extent necessary to maintain the optimum drill penetration rate. Thus, the controller regulates the speed of rotation of the drill string in response to the rate of penetration, while maintaining the effective weight of the drill string at a predetermined operating level, thereby maintaining a substantially constant rate of penetration.

The control 70 can also monitor the operation of the drill to detect and respond to conditions such as underground voids and broken formations encountered by the drill bit. In step 4 in FIG. 4, the control, by monitoring air line pressure through sensor 54, can detect unusual drops in the air pressure delivered to the pneumatic hammer, which signify that the bit has entered a void. When this condition occurs, the control causes the drill to revert to the approach step (step 2), in which the weight on the bit is reduced to a predetermined fraction of the desired weight, and gradually increased as air pressure builds up. The control can also monitor the torque in the drill string by monitoring the pressure of the hydraulic fluid driving the drill head through sensor 98. When the rotation pressure reaches a predetermined fraction, e.g., 60%, of the setting of torque limiter 92, the controller reduces the effective weight on the bit.

Both in the case of a void, or a broken formation, the weight on the drill bit is decreased either by increasing the holdback pressure by means of regulator 130 or decreasing the downfeed pressure by means of regulator 126, depending on which is in use. If necessary, when the drill string weight is close to the desired weight on the bit, the downfeed pressure can be released and holdback pressure applied to achieve the necessary decrease in weight on the bit. The weight on the bit remains at the decreased level until the conditions have been cleared.

In the fifth step depicted in FIG. 4, through feedback from the gearbox position sensor 104 (FIGS. 2 and 3), the controller is notified that the drill head is near the end of its travel. The controller operates the drill feed valve 112 and regulator 130, causing that hydraulic fluid to be delivered through line 120 to cylinder 100, so that the drill head is lifted through a short distance, e.g., a distance sufficient to lift the bit about 8 cm off the bottom of the bore hole. In this position, the bit cannot touch the bottom of the hole. The controller then causes the drill head to pause while the air pressure in line 38 falls. When the air pressure falls below about 200 psi, the controller reactivates the drill feed valve 112, causing the drill head to continue in the upward direction until the uppermost drill pipe in the drill string is in a position in which it can be detached from the drill head by engagement of a pipe holding fork with flat areas on the drill pipe. At the same time, the controller reduces the speed of rotation of the motor 44 by operating valve 62. At this point, operator intervention is required to disconnect the drill head from the uppermost length of drill pipe, for insertion of another length of drill pipe.

The drill bit on a "down-the-hole" pneumatic hammer has torque splines, which allow the bit to slide approximately 4 cm out of the bottom of the hammer assembly. When the bit is in the extended position, the piston of the hammer stops cycling. In the retracted position, the piston cycles, applying repeated blows to the anvil of the piston. In an intermediate position, the hammer continues to cycle, but, since the torque splines are not fully engaged, the cycling of the hammer can cause wear of the splines. The step of raising the drill bit off the bottom of the bore hole, stops the hammer from cycling. At the same time, during the pause in upward movement of the drill string, compressed air delivered through the drill string is discharged through the face of the drill bit, and passes upward along the borehole to the atmosphere, clearing the borehole of cuttings. Pausing with the bit at about 8 cm from the bottom of the borehole provides ideal conditions for borehole clearing.

As will be apparent from the preceding description, the invention provides for automated operation of a drill from the time at which a new pipe section is added to the drill string, to the time at which drilling has advanced by a distance corresponding to the length of the pipe section and the operator is ready to add a new pipe section to the drill string. The automated weighing of the drill string, the approach step in which the effective weight is reduced until air pressure delivered to the pneumatic hammer builds up to an operating level, and regulation of drilling progress by regulation of rotation speed, are particularly advantageous. These features and other features of the invention, including monitoring for voids and broken formations, and automated retraction upon completion, can be utilized individually and in various combinations.

The control although preferably implemented by a programmed logic array, can be a software programmed microprocessor control, and can even be implemented by discrete logic, and by various other known control apparatus. Various other modifications can be made to the apparatus and method described above without departing from the scope of the invention as defined in the following claims.

What is claimed is:

1. An earth drilling rig comprising:

a hydraulically operated drill head for rotating a hollow drill string, an elongated mast for supporting the drill head;

a hollow drill string comprising at least one pipe section connected to, and rotatable by, the drill head;

a hydraulically operated hoist for moving the drill head longitudinally along the mast;

a hydraulic pump mechanism for supplying hydraulic fluid under pressure for driving the drill head and said hoist;

a pneumatic hammer connected to the drill string;

a drill bit rotatable with the drill string and subject to repeated impact by the pneumatic hammer;

an air compressor, connected to the drill head, for causing compressed air to flow through the drill string for operation of the pneumatic hammer;

valving and regulators for controlling and regulating the flow of hydraulic fluid to the drill head and the hoist;

a sensor, comprising a transducer in direct fluid communication with to the hydraulic fluid for operating the hoist, said transducer providing an output signal representative of the pressure of the hydraulic fluid operating the hoist; and a programmed electronic control for controlling the flow of hydraulic fluid through said valving to the hoist and drill head, said control being responsive to said output signal of the transducer, connected to control operation of the hoist and drill head, and programmed to:

operate the hoist and drill head, while the bit is in a bore hole, to rotate the drill string, and raise the drill string to a fixed position by an amount sufficient to ensure that the bit is free to move vertically in the bore hole; and measure the hydraulic pressure required to hold the drill string in said fixed position, thereby obtaining a pressure measurement corresponding to the actual weight of the drill string.

2. An earth drilling rig according to claim 1, in which the hydraulically operated hoist comprises a piston and cylinder, the piston being movable in the cylinder by hydraulic fluid supplied by said hydraulic pump.

3. An earth drilling rig comprising:

a hydraulically operated drill head for rotating a hollow drill string, an elongated mast for supporting the drill head;

a hollow drill string comprising at least one pipe section connected to, and rotatable by, the drill head;

a hydraulically operated hoist for moving the drill head longitudinally along the mast;

a hydraulic pump mechanism for supplying hydraulic fluid under pressure for driving the drill head and said hoist;

a pneumatic hammer connected to the drill string;

a drill bit rotatable with the drill string and subject to repeated impact by the pneumatic hammer;

an air compressor, connected to the drill head, for causing compressed air to flow through the drill string for operation of the pneumatic hammer;

valving and regulators for controlling and regulating the flow of hydraulic fluid to the drill head and the hoist;

a sensor for sensing the pressure of the hydraulic fluid operating the hoist; and a programmed electronic control for controlling the flow of hydraulic fluid through said valving to the hoist and drill head, said control being responsive to said sensor, connected to control operation of the hoist and drill head, and programmed to:

operate the hoist and drill head, while the bit is in a bore hole, to rotate the drill string, and raise the drill string to a fixed position by an amount sufficient to ensure that the bit is free to move vertically in the bore hole; and measure the hydraulic pressure required to hold the drill string in said fixed position, thereby obtaining a pressure measurement corresponding to the actual weight of the drill string;

the earth drilling rig also including:

a drill head position sensor;

a sensor for sensing the pressure of the hydraulic fluid driving the drill head; and a sensor for sensing the pressure of the compressed air delivered through the drill string; and in which the programmed electronic control is also responsive to the drill head position sensor and to the sensor for sensing the pressure of the hydraulic fluid driving the drill head.

4. An earth drilling rig according to claim 3, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level; and regulate the pressure of the hydraulic fluid operating the hoist during drilling, and thereby maintain the effective weight of the drill string at said predetermined operating level.

5. An earth drilling rig according to claim 3, in which the programmed electronic control is also programmed to:

monitor the rate of penetration of the drill string, and regulate the speed of rotation of the drill string in response to the rate of penetration, thereby maintaining a substantially constant rate of penetration.

6. An earth drilling rig according to claim 3, in which the programmed electronic control is also programmed to:

regulate the pressure of the hydraulic fluid operating the hoist during drilling, and thereby maintain the effective weight of the drill string at a predetermined operating level; and monitor the rate of penetration of the drill string, and regulate the speed of rotation of the drill string in response to the rate of penetration, thereby maintaining a substantially constant rate of penetration.

7. An earth drilling rig according to claim 3, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level;

regulate the pressure of the hydraulic fluid operating the hoist during drilling, and thereby maintain the effective weight of the drill string at said predetermined operating level; and monitor the rate of penetration of the drill string, and regulate the speed of rotation of the drill string in response to the rate of penetration, thereby maintaining a substantially constant rate of penetration.

8. An earth drilling rig according to claim 2, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level;

regulate the pressure of the hydraulic fluid operating the hoist during drilling, and thereby maintain the effective weight of the drill string at said predetermined operating level;

monitor the rate of penetration of the drill string, and regulate the speed of rotation of the drill string in response to the rate of penetration, thereby maintaining a substantially constant rate of penetration; and reduce the effective weight on the bit to a fraction of said predetermined operating level when the pressure of the compressed air delivered to the pneumatic hammer falls below a predetermined level during drilling.

9. An earth drilling rig according to claim 3, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level;

regulate the pressure of the hydraulic fluid operating the hoist during drilling, and thereby maintain the effective weight of the drill string at said predetermined operating level;

monitor the rate of penetration of the drill string, and regulate the speed of rotation of the drill string in response to the rate of penetration, thereby maintaining a substantially constant rate of penetration; and monitor the torque in the drill string by monitoring the pressure of the hydraulic fluid driving the drill head, and reducing the effective weight on the bit when the torque exceeds a predetermined torque level.

10. An earth drilling rig according to claim 3, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level;

regulate the pressure of the hydraulic fluid operating the hoist during drilling, and thereby maintain the effective weight of the drill string at said predetermined operating level;

monitor the rate of penetration of the drill string, and regulate the speed of rotation of the drill string in response to the rate of penetration, thereby maintaining a substantially constant rate of penetration;

reduce the effective weight on the bit to a fraction of said predetermined operating level when the pressure of the compressed air delivered to the pneumatic hammer falls below a predetermined level during drilling; and monitor the torque in the drill string by monitoring the pressure of the hydraulic fluid driving the drill head, and reducing the effective weight on the bit when the torque exceeds a predetermined torque level.

11. An earth drilling rig according to claim 3, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level;

regulate the pressure of the hydraulic fluid operating the hoist during drilling, and thereby maintain the effective weight of the drill string at said predetermined operating level;

monitor the rate of penetration of the drill string, and regulate the speed of rotation of the drill string in response to the rate of penetration, thereby maintaining a substantially constant rate of penetration; and cause the drill head to retract the drill string by a predetermined distance sufficient to raise the drill bit off the bottom of the bore hole and pause, when the drill head position sensor indicates that the drill head has approached the lower limit of its travel on the mast, and cause the drill head to continue to retract the drill string to a position at which an additional drill pipe section can be added to the drill string.

12. An earth drilling rig according to claim 3, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level;

regulate the pressure of the hydraulic fluid operating the hoist during drilling, and thereby maintain the effective weight of the drill string at said predetermined operating level;

monitor the rate of penetration of the drill string, and regulate the speed of rotation of the drill string in response to the rate of penetration, thereby maintaining a substantially constant rate of penetration;

reduce the effective weight on the bit to a fraction of said predetermined operating level when the pressure of the compressed air delivered to the pneumatic hammer falls below a predetermined level during drilling; and cause the drill head to retract the drill string by a predetermined distance sufficient to raise the drill bit off the bottom of the bore hole and pause, when the drill head position sensor indicates that the drill head has approached the lower limit of its travel on the mast, and cause the drill head to continue to retract the drill string to a position at which an additional drill pipe section can be added to the drill string.

13. An earth drilling rig according to claim 3, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level;

regulate the pressure of the hydraulic fluid operating the hoist during drilling, and thereby maintain the effective weight of the drill string at said predetermined operating level;

monitor the rate of penetration of the drill string, and regulate the speed of rotation of the drill string in response to the rate of penetration, thereby maintaining a substantially constant rate of penetration;

monitor the torque in the drill string by monitoring the pressure of the hydraulic fluid driving the drill head, and reducing the effective weight on the bit when the torque exceeds a predetermined torque level; and cause the drill head to retract the drill string by a predetermined distance sufficient to raise the drill bit off the bottom of the bore hole and pause, when the drill head position sensor indicates that the drill head has approached the lower limit of its travel on the mast, and cause the drill head to continue to retract the drill string to a position at which an additional drill pipe section can be added to the drill string.

14. An earth drilling rig according to claim 3, in which the programmed electronic control is also programmed to:

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level;

regulate the pressure of the hydraulic fluid operating the hoist during drilling, and thereby maintain the effective weight of the drill string at said predetermined operating level;

monitor the rate of penetration of the drill string, and regulate the speed of rotation of the drill string in response to the rate of penetration, thereby maintaining a substantially constant rate of penetration;

reduce the effective weight on the bit to a fraction of said predetermined operating level when the pressure of the compressed air delivered to the pneumatic hammer falls below a predetermined level during drilling;

monitor the torque in the drill string by monitoring the pressure of the hydraulic fluid driving the drill head, and reducing the effective weight on the bit when the torque exceeds a predetermined torque level; and cause the drill head to retract the drill string by a predetermined distance sufficient to raise the drill bit off the bottom of the bore hole and pause, when the drill head position sensor indicates that the drill head has approached the lower limit of its travel on the mast, and cause the drill head to continue to retract the drill string to a position at which an additional drill pipe section can be added to the drill string.

15. An earth drilling rig comprising:

a hydraulically operated drill head for rotating a hollow drill string, an elongated mast for supporting the drill head;

a hollow drill string comprising at least one pipe section connected to, and rotatable by, the drill head;

a hydraulically operated hoist for moving the drill head longitudinally along the mast;

a hydraulic pump mechanism for supplying hydraulic fluid under pressure for driving the drill head and said hoist;

a pneumatic hammer connected to the drill string;

a drill bit rotatable with the drill string and subject to repeated impact by the pneumatic hammer;

an air compressor, connected to the drill head, for causing compressed air to flow through the drill string for operation of the pneumatic hammer;

valving and regulators for controlling and regulating the flow of hydraulic fluid to the drill head and the hoist;

a drill head position sensor;

a sensor for sensing the pressure of the hydraulic fluid operating the hoist; and a sensor for sensing the pressure of the compressed air delivered through the drill string to the pneumatic hammer;

wherein an effective weight is exerted on the drill bit equal to the weight of the drill head plus the weight of the drill string, adjusted by any upward or downward force exerted by the hoist; and a programmed electronic control for controlling the flow of hydraulic fluid through said valving to the hoist and drill head, said control being responsive to said sensors, connected to control operation of the hoist and drill head, and programmed to:

operate the hoist and drill head, while the bit is in a bore hole, to rotate the drill string, and raise the drill string to a fixed position by an amount sufficient to ensure that the bit is free to move vertically in the bore hole;

lower the drill string to engage the bit with the bottom of the bore hole;

regulate the pressure of the hydraulic fluid operating the hoist while monitoring the pressure of compressed air delivered to the pneumatic hammer, and thereby maintaining the effective weight on the bit at a fraction of a predetermined operating level until the air delivered to the pneumatic hammer reaches a predetermined air operating level; and regulate the pressure of the hydraulic fluid operating the hoist during drilling, and thereby maintain the effective weight of the drill string at said predetermined operating level.

16. An earth drilling rig according to claim 15, in which the programmed electronic control is also programmed to:

monitor the rate of penetration of the drill string, and regulate the speed of rotation of the drill string in response to the rate of penetration, thereby maintaining a substantially constant rate of penetration.

17. An earth drilling rig comprising:

a hydraulically operated drill head for rotating a hollow drill string, an elongated mast for supporting the drill head;

a hollow drill string comprising at least one pipe section connected to, and rotatable by, the drill head;

a hydraulically operated hoist for moving the drill head longitudinally along the mast;

a hydraulic pump mechanism for supplying hydraulic fluid under pressure for driving the drill head and said hoist;

a pneumatic hammer connected to the drill string;

a drill bit rotatable with the drill string and subject to repeated impact by the pneumatic hammer;

an air compressor, connected to the drill head, for causing compressed air to flow through the drill string for operation of the pneumatic hammer;

valving and regulators for controlling and regulating the flow of hydraulic fluid to the drill head and the hoist;

a drill head position sensor;

a sensor for sensing the pressure of the hydraulic fluid operating the hoist;

a sensor for sensing the pressure of the hydraulic fluid driving the drill head; and a programmed electronic control for controlling the flow of hydraulic fluid through said valving to the hoist and drill head, said control being responsive to said sensors, connected to control operation of the hoist and drill head, and programmed to:

maintain the effective weight of the drill string at a predetermined operating level by controlling the pressure of the hydraulic fluid operating the hoist, monitor the rate of penetration of the drill string, and regulate the speed of rotation of the drill string in response to the rate of penetration, thereby maintaining a substantially constant rate of penetration.

* * * * *